US009839990B2

(12) United States Patent
Hänni et al.

(10) Patent No.: US 9,839,990 B2
(45) Date of Patent: Dec. 12, 2017

(54) GRINDING WHEEL AND METHOD OF REINFORCING THE SAME

(71) Applicant: REISHAUER AG, Wallisellen (CH)

(72) Inventors: Florian Hänni, Wallisellen (CH); Martin Pavlovic, Brüttisellen (CH); Thomas Sigrist, Wallisellen (CH)

(73) Assignee: Reishauer AG, Wallisellen (CH)

( * ) Notice: Subject to any disclaimer, the term of this patent is extended or adjusted under 35 U.S.C. 154(b) by 0 days.

(21) Appl. No.: 14/779,049

(22) PCT Filed: Feb. 5, 2014

(86) PCT No.: PCT/EP2014/052211

§ 371 (c)(1),
(2) Date: Sep. 22, 2015

(87) PCT Pub. No.: WO2014/154386

PCT Pub. Date: Oct. 2, 2014

(65) Prior Publication Data

US 2016/0158919 A1 Jun. 9, 2016

(30) Foreign Application Priority Data

Mar. 26, 2013 (EP) ..... 13161044

(51) Int. Cl.
*B24D 3/34* (2006.01)
*B24D 5/04* (2006.01)
*B24D 18/00* (2006.01)

(52) U.S. Cl.
CPC ..... *B24D 3/348* (2013.01); *B24D 5/04* (2013.01); *B24D 18/0027* (2013.01)

(58) Field of Classification Search
CPC ..... B24D 3/348; B24D 5/04; B24D 18/0027
(Continued)

(56) References Cited

U.S. PATENT DOCUMENTS 1,884,279 A * 10/1932 Scheel ..... B24D 5/04 51/293
2,006,308 A * 6/1935 Bush ..... B24D 5/04 451/544

(Continued)

FOREIGN PATENT DOCUMENTS

AT 502845 A1 6/2007
DE 1261772 B2 2/1968

(Continued)

OTHER PUBLICATIONS

Abstract of JP 2000153464A.

*Primary Examiner* — George Nguyen
(74) *Attorney, Agent, or Firm* — Brian Roffe

(57) ABSTRACT

Method for reinforcing a grinding wheel, preferably for grinding gears. By means of at least one plastic that is poured in, both a ring lining a bore of the grinding wheel and a reinforcing layer are formed in the grinding wheel pores. The plastic that is poured in preferably consists of a potting compound, used in the raw state, made of a 2-component polyurethane system. In order to produce the reinforcement, the grinding wheel is set rotating, i.e., rotated, and, at the same time, a specific quantity of potting compound is poured into the bore. An increase in the explosion speed during operation of the grinding wheel is thereby made possible.

20 Claims, 1 Drawing Sheet

(58) Field of Classification Search
USPC ..... 451/546
See application file for complete search history.

(56) References Cited

U.S. PATENT DOCUMENTS

| | | | | | |
|---|---|---|---|---|---|
| 2,094,556 | A * | 9/1937 | Anderson | B24D 5/04 | 451/536 |
| 3,526,063 | A * | 9/1970 | Cook | B24D 5/04 | 451/546 |
| 3,939,612 | A * | 2/1976 | Peterson | B24D 5/04 | 451/546 |
| 3,973,737 | A * | 8/1976 | Thorsell | B24B 41/04 | 241/294 |
| 4,062,153 | A * | 12/1977 | Malm | B24D 5/066 | 451/544 |
| 4,137,516 | A * | 1/1979 | Shaw | H01C 3/14 | 338/292 |
| 5,343,656 | A * | 9/1994 | Loos | B24D 18/0054 | 451/540 |
| 5,658,194 | A * | 8/1997 | Micheletti | B24B 9/10 | 451/540 |
| 6,257,963 | B1 | 7/2001 | Thyssen | | |
| 6,663,481 | B2 * | 12/2003 | Nauche | B24D 5/16 | 451/541 |
| 7,018,278 | B2 | 3/2006 | Wirz | | |
| 8,628,385 | B2 * | 1/2014 | Wu | B24D 3/346 | 451/28 |
| 2001/0018324 | A1 * | 8/2001 | Ito | B24B 5/02 | 451/542 |
| 2003/0032384 | A1 * | 2/2003 | Terada | B24D 5/16 | 451/541 |
| 2004/0082290 | A1 * | 4/2004 | Yoshida | B24D 5/14 | 451/546 |
| 2007/0004180 | A1 * | 1/2007 | Abe | B24B 7/228 | 438/460 |

FOREIGN PATENT DOCUMENTS

| | | | |
|---|---|---|---|
| GB | 1176896 | A | 1/1970 |
| JP | 2000153464 | A | 6/2000 |
| WO | 2015018627 | A1 | 2/2015 |

* cited by examiner

GRINDING WHEEL AND METHOD OF REINFORCING THE SAME

FIELD OF THE INVENTION

The invention relates to a grinding wheel, preferably for grinding gears, provided with a bore serving to fasten it and with a reinforcing layer, and to a method of reinforcing the grinding wheel.

BACKGROUND OF THE INVENTION

These types of grinding wheel are used, for example, in the machining of gears for car gearing mechanisms. In order to improve the productivity and the economy of the grinding process, one is seeking to constantly increase the cutting speeds during continuous generative grinding. Safety standards are to be observed here, according to which the admissible cutting speed must be at a specific ratio to the explosion speed of the grinding wheel.

The reinforcement of the grinding wheel in the region of the bore makes higher admissible cutting speeds possible, but is associated with likewise higher manufacturing costs. This also applies to a known grinding wheel according to publication JP-A-2000153 464, the reinforcement of which with a multi-layered net is costly to manufacture.

OBJECTS AND SUMMARY OF THE INVENTION

In contrast, it is the object of the invention to devise a grinding wheel of the type specified at the start that makes it possible to increase the explosion speed during operation of the grinding wheel.

According to the invention this object is achieved in that by means of at least one plastic that is poured in, both a ring lining the bore and this reinforcing layer are formed in the grinding wheel pores. A 2-component polyurethane system has proven to be particularly suitable as a potting compound.

By reinforcing the grinding wheel with an appropriate potting compound a close connection is established between the latter and the porous material of the grinding wheel because this potting compound, that flows into the finest of wheel pores, ensures secure joining with the material of the grinding wheel. Pouring the potting compound into the bore of the rotating grinding wheel and thereby regulating the penetration depth of the reinforcing material is easy to achieve in production. In this way the thickness of the reinforcing ring lining the bore can also be varied within certain limit values.

In order to produce the reinforcement the grinding wheel according to the invention is set rotating, preferably with a horizontally aligned axis of rotation and at, for example 400 rpm (revolutions per minute), and a specific amount of potting compound is poured into the bore, it being possible to adjust the depth of penetration of the adhesive into the grinding wheel and the thickness of the reinforcing ring within specific limit values by adapting the spin speed and/or the amount, the degree of fluidity and the curing time of the potting compound used.

It is advantageous here to attach sealing elements to the outside of the grinding wheel, the purpose of which is to prevent the potting compound that has been poured in from running out at the side in an uncontrolled manner.

BRIEF DESCRIPTION OF THE DRAWINGS

The invention is described in more detail below by means of an exemplary embodiment with reference to the drawings. These show as follows.

DETAILED DESCRIPTION OF THE INVENTION

Figure 1:
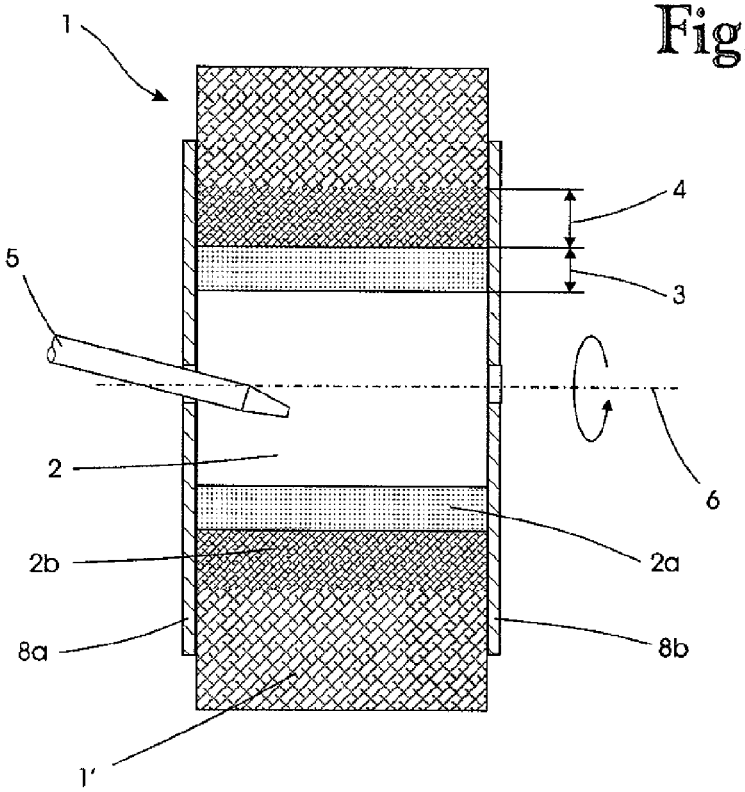
FIG. 1 is an arrangement for reinforcing a grinding wheel with a potting compound, shown in section and diagrammatically.
Figure 2:
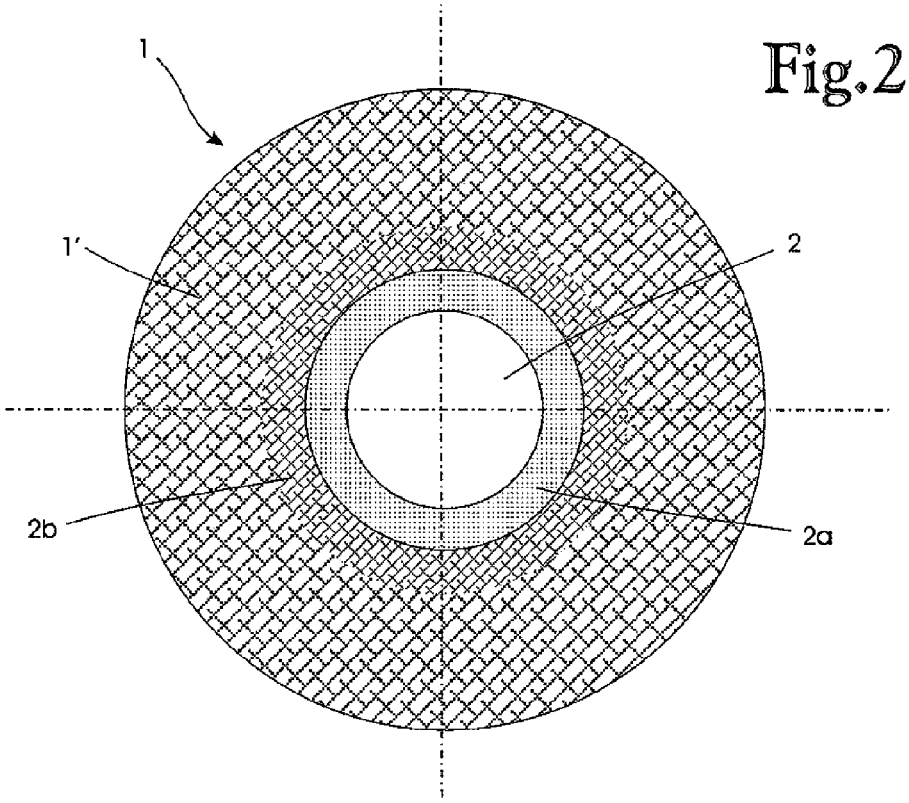
FIG. 2 is a side view of the grinding wheel.

The arrangement according to FIG. 1 shows a grinding wheel 1 made of porous, ceramic material, preferably being produced from corundum. Instead of corundum, other ceramic materials with a similar porous structure can also of course be used. The grinding wheel 1 is provided here with a bore 2, in particular for fastening it to a spindle of a machine tool.

According to the invention, both a ring 2*a* lining the bore 2 and this reinforcing layer 2*b* are formed by at least one plastic that has been poured into the grinding wheel pores 1'. The grinding wheel is produced from an open to highly porous structure, advantageously with a porosity of over 50 volume percent.

For the plastic provided to reinforce the grinding wheel a potting compound composed of a 2-component polyurethane system is advantageously used which, as regards its physical properties and also due to its economy is particularly suitable for use of potting compound to produce the ring 2*a* and to fill the wheel pores 1' in the region of the ring-shaped reinforcing layer 2*b*. Needless to say, other suitable potting compounds can also be used.

The potting compound is poured into the bore 2 of the grinding wheel 1 by means of a pouring device of which only a feed nozzle 5 is shown which guides the potting compound into the region of the bore 2. In order to prevent the potting compound from running out in an uncontrolled manner after being fed into the bore 2, sealing elements 8*a*, 8*b* are provided arranged on the outside of the grinding wheel 2.

In order to produce the ring 2*a* surrounding the bore 2 as well as the reinforcing layer 2*b* in the grinding wheel pores 1' of the grinding wheel 1, the latter is set rotating about the horizontally aligned axis of rotation 6 by a drive (not shown), while a specific amount of potting compound is introduced by means of the pouring device with the feed nozzle 5. The grinding wheel 1 rotates here at a speed of for example 400 rpm (rotations per minute), the potting compound that has been poured in penetrating into the pores 1' of the grinding wheel by means of the centrifugal force which is then effective and connecting to its ceramic material.

The penetration depth 4 that can be achieved here and also the wall thickness 3 of the ring 2*a* are dependent upon the spin speed and the amount that has been poured in, as well as upon the degree of fluidity and the curing time of the potting compound used. By varying these values the wall thickness 3 and the penetration depth of the potting compound and the thickness of the reinforcing layer 2*b* can be regulated within specific limit values.

In order to achieve even higher explosion speeds, it is basically also possible to additionally reinforce the grinding wheel with a metal ring that has been glued in, assuming, however, that there will be correspondingly higher apparatus and production costs. One or a number of metal rings, wires or the like could also be inserted in the bore when pouring in the potting compound and have adhesive poured around them and be embedded after curing in the ring 2*a*.

In principle, the plastic poured in in order to form the ring and the reinforcing layer in the pores of the grinding wheel could be formed by pouring in different potting compound or adhesive compound materials layer by layer.

Another method for producing the grinding wheels according to the invention could also basically be used, for example by pressure casting or a combination with a centrifugal process.

The invention claimed is:

1. A method of reinforcing a grinding wheel having pores, comprising:

rotating the grinding wheel; and pouring, while the grinding wheel is rotating, a specific amount of potting compound into a bore in the grinding wheel in order to form a ring lining the bore and a reinforcing layer underneath the ring resulting from penetration of the potting compound into the pores of the grinding wheel.

2. The method according to claim 1, further comprising attaching sealing elements to an outside of the grinding wheel in order to prevent the potting compound that is being poured into the bore from running out of the bore.

3. The method according to claim 1, further comprising adjusting a thickness of the ring and a penetration depth of the potting compound into the grinding wheel by regulating at least one characteristic of the grinding wheel, at least one characteristic of the pouring of the potting compound or at least one characteristic of the potting compound.

4. The method according to claim 1, wherein the grinding wheel is rotated at an almost constant speed.

5. The method according to claim 1, wherein the grinding wheel is rotated at a constant speed of 400 rpm (revolutions per minute).

6. The method according to claim 1, wherein the grinding wheel is set with a horizontally aligned axis of rotation.

7. The method according to claim 1, wherein the bore is configured to fasten the grinding wheel.

8. The method according to claim 1, wherein the grinding wheel is configured to grind gears.

9. The method according to claim 1, wherein the step of pouring, while the grinding wheel is rotating, a specific amount of potting compound into the bore comprises pouring plastic in fluid form as the potting compound into the bore.

10. The method according to claim 9, wherein the plastic that is poured into the bore comprises a two- or multi-component polyurethane compound.

11. The method according to claim 1, wherein the potting compound that is poured into the bore comprises a two- or multi-component polyurethane compound.

12. The method according to claim 1, wherein the grinding wheel has an open to highly porous structure.

13. The method according to claim 1, further comprising arranging a sealing element on each axial end of the grinding wheel to prevent the potting compound being poured into the bore from leaving the bore.

14. The method according to claim 1, further comprising controlling a thickness of the ring and a penetration depth of the potting compound into the grinding wheel by controlling the specific amount of potting compound being poured into the bore.

15. The method according to claim 1, further comprising adjusting a thickness of the ring and a penetration depth of the potting compound into the grinding wheel by changing a speed of rotation of the grinding wheel.

16. The method according to claim 1, further comprising adjusting a thickness of the ring and a penetration depth of the potting compound into the grinding wheel by changing the specific amount of the potting compound being poured into the bore.

17. The method according to claim 1, wherein the potting compound is fluid, further comprising adjusting a thickness of the ring and a penetration depth of the potting compound into the grinding wheel by changing a degree of fluidity of the potting compound being poured into the bore.

18. The method according to claim 1, wherein the potting compound is curable, further comprising adjusting a thickness of the ring and a penetration depth of the potting compound into the grinding wheel by changing a curing time of the potting compound being poured into the bore.

19. The method according to claim 1, wherein the potting compound is fluid and curable, further comprising adjusting a thickness of the ring and a penetration depth of the potting compound into the grinding wheel by at least one of changing a speed of rotation of the grinding wheel, changing the specific amount of the potting compound being poured into the bore, changing a degree of fluidity of the potting compound being poured into the bore and changing a curing time of the potting compound being poured into the bore.

20. The method according to claim 1, wherein the step of pouring the specific amount of potting compound into the bore comprises positioning an outlet of a feed nozzle in the bore and introducing the potting compound into the bore through the feed nozzle.

* * * * *